United States Patent [19]

Carson et al.

[11] Patent Number: 4,730,657

[45] Date of Patent: Mar. 15, 1988

[54] METHOD OF MAKING A MOLD

[75] Inventors: Daniel P. Carson, Minerva; Francis E. Cozza, Hanoverton, both of Ohio

[73] Assignee: PCC Airfoils, Inc., Euclid, Ohio

[21] Appl. No.: 854,338

[22] Filed: Apr. 21, 1986

[51] Int. Cl.[4] ..... B22C 7/02; B22C 9/04

[52] U.S. Cl. ..... 164/23; 164/35; 164/45; 164/137

[58] Field of Search ..... 164/35, 34, 36, 45, 164/137, 23

[56] References Cited

U.S. PATENT DOCUMENTS 4,651,799 3/1987 Chandley ..... 164/35

4,667,728 5/1987 Graham ..... 164/129

*Primary Examiner*—Nicholas P. Godici

*Assistant Examiner*—J. Reed Batten, Jr.

*Attorney, Agent, or Firm*—Tarolli, Sundheim & Covell

[57] ABSTRACT

Both a pattern member and a body of expansion material are covered with a layer of ceramic mold material. The body of expansion material has a coefficient of thermal expansion which is greater than the coefficient of thermal expansion of the ceramic mold material. The layer of ceramic mold material and the body of expansion material are heated. This results in a cracking of the layer of ceramic mold material by the body of expansion material due to greater thermal expansion of the body of expansion material as it is heated. During the step of heating the ceramic mold material and body of expansion material, the pattern member is melted to separate the pattern from the layer of ceramic mold material.

24 Claims, 10 Drawing Figures

METHOD OF MAKING A MOLD

BACKGROUND OF THE INVENTION

The present invention relates to a new and improved method of making a mold and more specifically to a method in which a section of ceramic mold material is separated from another section of ceramic mold material.

During the making of a mold it may be necessary to separate one section of a layer of ceramic mold material from another section of the layer of ceramic mold material. For example, when a pour cup is made, a generally conical pattern is covered with a layer of ceramic mold material. It is necessary to separate the portion of the layer of ceramic mold material overlying the circular base of the conical pattern from the remainder of the layer of ceramic mold material in order to open the pour cup. This has previously been done by a time consuming abrading or cutting operation.

A mold assembly having a plurality of separate sections is disclosed in U.S. Pat. No. 4,066,116. In forming the various sections of the mold assembly, a wax pattern is repetitively dipped in a slurry of ceramic mold material. The resulting wet layer of ceramic mold material is separated into sections by wiping away a portion of the layer of ceramic mold material. After the ceramic mold material has dried, the mold sections can be separated at the location where a discontinuity was formed during the step of wiping away the wet ceramic mold material.

Another mold having a plurality of sections is described in International Patent Application Serial No. PCT/US86/00166 entitled "Method and Apparatus for Casting Articles" filed Jan. 28, 1986 for Lawrence Graham, Richard Skelley, Daniel Fetsko, and Ronald Ardo. The mold disclosed in this application includes separable upper and lower sections. The mold may be formed by repetitively dipping a wax pattern in a slurry of ceramic mold material. After the ceramic mold material on the pattern has dried, the ceramic mold material is cut to separate the upper and lower sections of the mold.

BRIEF SUMMARY OF THE INVENTION

The present invention provides a new and improved method of making a ceramic mold by covering a pattern member and a body of expansion material with a layer of ceramic mold material. The body of expansion material has a greater coefficient of expansion than the layer of ceramic mold material. Therefore, when the body of expansion material and the layer of ceramic mold material are heated, thermal expansion forces are applied against the layer of ceramic mold material by the body of expansion material to crack the layer of ceramic mold material. The cracking of the layer of ceramic mold material results in one section of the layer of ceramic mold material being disconnected from an adjoining section of the layer of ceramic mold material.

When a mold having two parts which can be separated is to be formed in accordance with the present invention, patterns having configurations corresponding to the configurations of the two parts of the mold are provided. The patterns are aligned with one another and have interposed therebetween one or more bodies of expansion material. The resulting pattern assembly is covered with a layer of ceramic mold material. The layer of ceramic mold material extends between and overlies the patterns and the expansion material between the patterns.

The expansion material has a greater coefficient of thermal expansion than the ceramic mold material. The bodies of expansion material are of the appropriate size and shape to crack the desired locations in the ceramic mold material while leaving the other portions of the ceramic mold material undisturbed. Therefore, when the expansion material is heated, it cracks the layer of ceramic mold material to separate the portion of the layer of ceramic mold material overlying one pattern from the ceramic mold material overlying the other pattern.

Accordingly, it is an object of this invention to provide a new and improved method of forming a mold and wherein a body of expansion material having a greater coefficient of thermal expansion than a layer of ceramic mold material is heated to crack or form discontinuities in the layer of ceramic mold material.

It is another object to construct a ceramic mold formed of separate interfitting parts by forming separate wax patterns of the parts and assembling the wax patterns into a unitized pattern structure with bodies of expansion material interposed between the connecting parts of the wax patterns so that the pattern assembly can be covered with ceramic mold material as a single unit.

BRIEF DESCRIPTION OF THE DRAWINGS

The foregoing and other objects and features of the present invention will become more apparent upon a consideration of the following description taken in connection with the accompanying drawings wherein.

DESCRIPTION OF SPECIFIC PREFERRED EMBODIMENTS OF THE INVENTION

General Description

Figure 1:
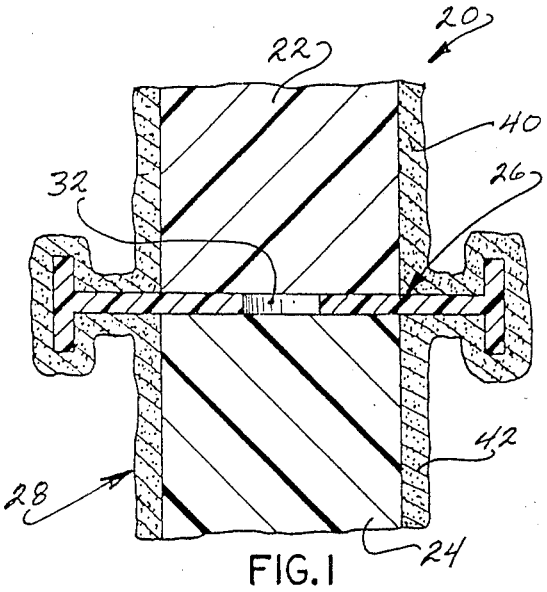
FIG. 1 is a schematic illustration depicting the manner in which a layer of ceramic mold material overlies a pair of pattern sections and a body of expansion material.

A pattern assembly 20 (FIG. 1) for use in forming a mold or a part of a mold includes a first or upper pattern section 22 and a second or lower pattern section 24. A body 26 of expansion material is disposed between the upper and lower patterns 22 and 24. A wet coating or layer 28 of ceramic mold material is disposed over the pattern assembly 20. The layer 28 of ceramic mold material overlies the upper and lower patterns 22 and 24 and the body 26 of expansion material.

After the layer 28 of ceramic mold material has been at least partially dried, it is necessary to remove the upper and lower pattern sections from within the layer 28 of ceramic mold material. To facilitate removal of the upper and lower patterns 22 and 24 from within the layer 28 of ceramic mold material, the patterns are formed of either a natural or artificial wax which is melted upon being heated to a temperature above its melting point, for example to 150 degrees F. As the the upper and lower patterns 22 and 24 are melted, the liquid wax from the lower pattern section 24 is conducted from inside the layer of ceramic mold material 28 through a suitable opening. The molten material of the upper pattern section 22 flows through an opening 32 formed in the body 26 of expansion material and out of the opening in the lower portion of the layer of ceramic mold material.

During heating of the ceramic mold material 28 to remove the material of the patterns 22 and 24, the portion of the layer of ceramic mold material overlying the upper pattern 22 is disconnected from the portion of the layer of ceramic mold material overlying the lower pattern 24. This is accomplished by thermally expanding the body 26 of expansion material to crack the layer 28 of ceramic mold material in the manner indicated schematically at 36 in FIG. 2.

The body 26 of expansion material has a coefficient of thermal expansion which is greater than the coefficient of thermal expansion of the layer 28 of ceramic mold material. Therefore, upon heating of the body 26 of expansion material, it expands to a greater extent than the layer 28 of ceramic mold material. This results in the application of thermal expansion forces against the inside of the layer 28 of ceramic mold material. These thermal expansion forces cause cracks 36 to form in the layer 28 of ceramic mold material.

It should be noted that the melting temperature of the body 26 of expansion material is substantially greater than the melting temperature of the patterns 22 and 24. Therefore, the expansion material 26 remains intact during melting of the patterns 22 and 24.

Since the body 26 of expansion material was disposed between the upper and lower patterns 22 and 24, the cracks 36 disconnect the portion of the layer 28 of ceramic mold material overlying the upper pattern section 22 from the portion of the layer of ceramic mold material overlying the lower pattern section 24. This results in the formation of an upper mold section 40 having a configuration corresponding to the configuration of the upper pattern 22 and a lower mold section 42 having a configuration corresponding to the configuration of the lower pattern 24. The upper and lower mold sections 40 and 42 can be easily separated at the cracks 36. Once the upper and lower mold sections 40 and 42 have been separated, the body 26 of expansion material is removed. The relatively rough surfaces of the mold sections formed by the cracks 36 may be ground or abraded to have a desired smoothness.

The body 26 of expansion material may be formed of any desired substance having a greater coefficient of thermal expansion than the coefficient of thermal expansion of the ceramic mold material 28. In one specific instance the body 26 of the expansion material was formed of a polymeric material which is commercially available under the trademark "Teflon". The coefficient of thermal expansion of "Teflon", that is, the change in length per unit length per degree change in temperature, is approximately 110 per degree centigrade. The sublimation temperature of "Teflon" is approximately 1500 to 1700 degrees F.

The layer 28 of ceramic mold material was applied over the pattern assembly 20 by repetitively dipping the pattern assembly in a liquid slurry of ceramic mold material. The slurry of ceramic mold material contained fused silica, zircon, and other refractory materials in combination with binders. Chemical binders such as ethyl silicate, sodium silicate and colloidal silica can be utilized. In addition, the slurry may contain suitable film formers such a alginates to control viscosity and wetting agents to control flow characteristics and pattern wettability. The layer 28 of ceramic mold material has a coefficient of thermal expansion of approximately 10 per degree centigrade.

Although the body 26 of expansion material has been illustrated in FIG. 1 in association with a pair of patterns 22 and 24, the body of expansion material could be used in association with a single pattern member. The body 26 of expansion material has been shown as being a sheet. The body 26 of expansion material could have a different configuration if desired. Although it is preferred to make the body 26 of "Teflon", other materials could be used if desired. However, the body 26 of expansion material must have a coefficient of thermal expansion which is greater than the coefficient of thermal expansion of the layer 28 of ceramic mold material.

Mold

Figure 3:
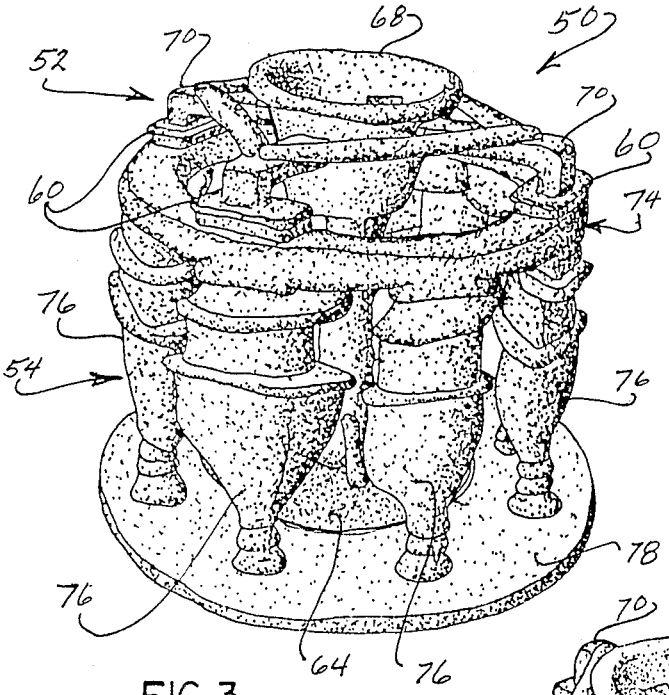
FIG. 3 is a pictorial illustration of a ceramic mold assembly.
Figure 4:
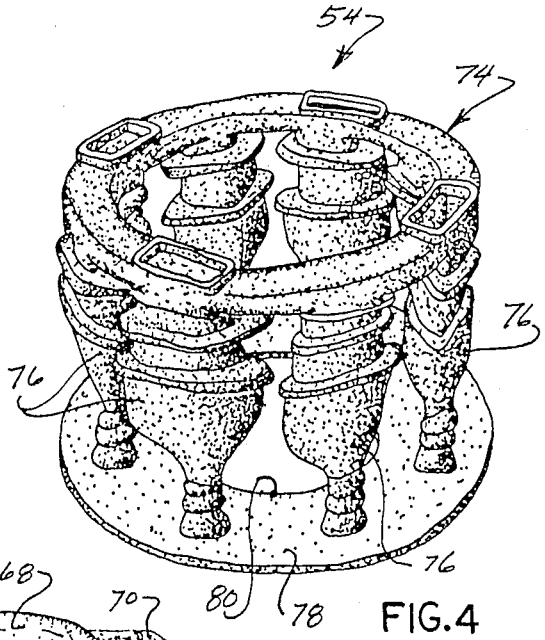
FIG. 4. is a pictorial illustration of a ceramic lower section of the mold assembly of FIG. 3 and illustrating the relationship between a secondary molten metal distribution system, a plurality of article molds and a base plate.
Figure 5:
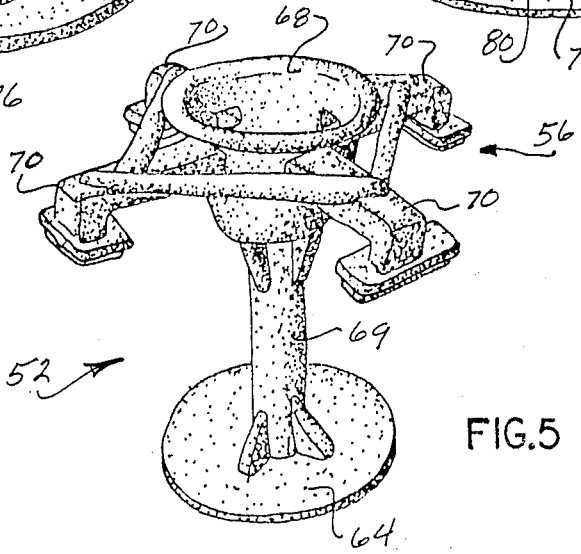
FIG. 5 is a pictorial illustration of a ceramic upper section of the mold assembly of FIG. 3 and illustrating the relationship between a primary molten metal distribution system and a baffle plate.

The present invention can advantageously be used in the formation of a mold assembly 50 (FIG. 3). The mold assembly 50 includes a ceramic upper mold section 52 (FIG. 5) which is separable from and fittingly engages a ceramic lower mold section 54 (FIG. 4). The upper mold section 52 includes a primary molten metal distribution system 56 which conducts molten metal to the lower mold section 54 through a plurality of joints 60 (FIG. 3) between the upper and lower mold sections.

The upper mold section 52 (FIG. 5) includes a circular ceramic baffle plate 64. The baffle plate 64 is connected with a pour cup 68 in the primary molten metal distribution system 56 by a ceramic post 69. The primary molten metal distribution system 56 includes a plurality of hollow runners or arms 70 which extend radially outwardly from the pour cup 68 to the joints 60 (FIG. 3).

The lower mold section 54 includes a hollow annular secondary molten metal distribution system 74 (FIG. 4) which is connected in fluid communication with the primary molten metal distribution system 56 through the joints 60. The ceramic secondary molten metal distribution system 74 is also connected in fluid communication with a plurality of ceramic article molds 76 which extend between the secondary molten metal distribution system 74 and an annular base plate 78. The ceramic base plate 78 has a circular opening 80 which receives the baffle plate 64 when the upper and lower mold sections 52 and 54 are interconnected at the separable joints 60.

When a plurality of articles are to be cast with the mold 50, the mold is raised into a furnace and the upper mold section 52 is connected with an upper end wall of the furnace. Molten metal is then poured into the pour cup 68. The molten metal flows from the pour cup 68 through the primary distribution system 56 and joints 60 to the secondary distribution system 74. The molten metal then flows from the secondary distribution system 74 to the article molds 76.

Once the article molds 76 have been filled with molten metal, the lower mold section 54 is gradually lowered from the furnace. As this occurs, the upper and lower mold sections 52 and 54 separate at the joints 60 and the article molds 76 move downwardly past the stationary baffle plate 64. The manner in which the mold assembly 50 is used to cast a plurality of articles is more fully explained in the aforementioned International Application Serial No. PCT/US86/00166 and will not be further described herein to avoid prolixity of description.

Mold Formation - Connections Between Mold Sections

When the mold assembly 50 is being constructed, a wax upper pattern 86 (FIG. 6) having a configuration corresponding to the configuration of the upper mold section 52 is formed. A wax lower pattern 88 having a configuration corresponding to the configuration of the lower mold section 54 is also formed. Although only portions of the upper and lower patterns 86 and 88 have been shown in FIG. 6, it should be understood that the patterns 86 and 88 have the same configuration as the upper and lower mold sections 52 and 54. The patterns 86 and 88 are constructed by injection molding wax components and interconnecting these components to form each of the patterns.

Since the upper and lower mold sections 52 and 54 are separable at the joints 60 which conduct molten metal between the upper and lower mold sections, openings must be formed in the upper and lower mold sections at locations corresponding to each of the joints 60. Thus, in the illustrated embodiment of the invention, the upper and lower patterns 86 and 88 are disposed adjacent to each other at four spaced apart locations corresponding to the four joints 60 where the runners 70 of the primary metal distribution system 56 are connected in fluid communication with the annular passage of the secondary metal distribution system 74. A body 92 of expansion material is positioned between the upper and lower pattern sections 86 and 88 at each of the four locations. Surprisingly it has been found that the manner of cracking the ceramic mold material can be controlled by extending a portion of the member 92 so that it is embedded in the ceramic mold material outside the pattern interface.

The passages in the arms or runners 70 of the primary distribution system 56 have a rectangular cross-sectional configuration. Therefore, the patterns 86 and 88 have rectangular cross-sectional configurations at the locations where the openings for the joints 60 are to be formed. The body 92 of expansion material also has a rectangular configuration. However, the body 92 of expansion material is large enough to project outwardly from the upper and lower patterns 86 and 88. The body 92 of expansion material is made of "Teflon".

The upper and lower patterns 86 and 88 are interconnected with the bodies 92 of expansion material between the patterns to form a pattern assembly 94. The entire pattern assembly 94 is covered with a coating or layer 96 of ceramic mold material by repetitively dipping the pattern assembly in a slurry of ceramic mold material. The pattern assembly 94 is dipped until a wet layer 96 of ceramic mold material having a thickness of approximately 0.4 inches is built up over the pattern assembly.

The pattern assembly 94 is then heated to dry the wet layer 96 of ceramic mold material and melt the upper and lower patterns 86 and 88. As the patterns 86 and 88 are melted, the wax in the lower pattern 88 flows out of the dried layer 96 of ceramic mold material through a suitable opening. The wax from part of the pattern flows by gravity from the upper mold part to the lower mold part through an opening 100 formed in the body 92 of expansion material. This wax then flows from the opening in the layer 96 of ceramic mold material.

The four bodies 92 of expansion material have a larger coefficient of thermal expansion than the layer 96 of ceramic mold material. Therefore, as the bodies 92 of expansion material are heated during the dewaxing of the layer 96 of ceramic mold material, the bodies of the expansion material expand to a greater extent than the ceramic mold material. This results in the generation of thermal expansion forces of a magnitude sufficient to crack the layer 96 of mold material in the manner indicated schematically at 104 in FIG. 7.

The crack 104 disconnects the portion of the layer 96 of ceramic mold material corresponding to the upper section 52 of the mold from the portion of the layer 96 of ceramic mold material corresponding to the lower section 54 of the mold. A crack corresponding to the crack 104 is formed at each of the four locations corresponding to the joints 60. This enables the upper and lower mold sections 52 and 54 to be separated at the cracks 104.

Once the mold sections have been separated, the bodies 92 of expansion material are removed. Rectangular flanges 108 (FIG. 7) on the lower mold section 54 are removed and the lower mold section is telescopically inserted into the upper mold section 52 in the manner shown in FIG. 8. This results in the formation of separable joints 60 between the upper and lower mold sections 52 and 54. Although only one of the joints 60 has been shown in FIG. 8, it should be understood that the other joints 60 have the same construction and are formed in the same manner as the joint 60 shown in FIG. 8.

Mold Formation- Baffle Plate

During use of the mold assembly 50 (FIG. 3) to cast a plurality of articles, the lower mold section 54 is moved downwardly away from the upper mold section 52 and withdrawn from a furnace. This requires that the baffle plate 64, connected with the upper mold section 52, be separate from the base plate 78 of the lower mold section 54. In addition, the baffle plate 64 must be small enough to pass through the open central portion of the lower mold section 54.

Figure 9:
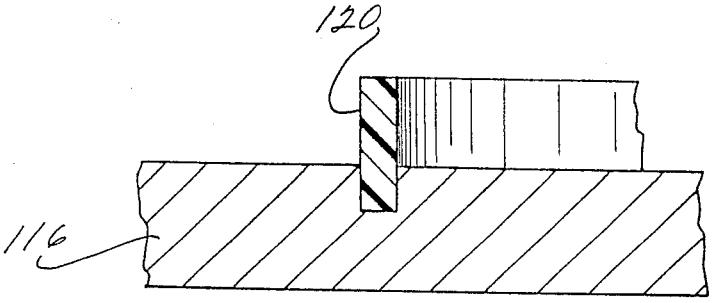
FIG. 9 is a sectional view illustrating the manner in which a ring of expansion material is mounted on a pattern plate.

The circular baffle plate 64 and annular base plate 78 (FIG. 3) are formed on a single circular metal pattern member or plate 116 (FIG. 9) having an outside diameter which is approximately the same as the outside diameter of the annular base plate 78. A circular ring 120 of expansion material is mounted on the pattern plate 116 in a coaxial relationship with the pattern plate. The circular ring 120 is formed of "Teflon" and has an inside diameter which is approximately the same as the outside diameter of the circular baffle plate 64. The circular ring 120 has an outside diameter which is approximately the same as the inside diameter of the circular opening 80 in the base plate 78.

The lower pattern 88 (FIG. 6) is mounted on the pattern plate 116 (FIG. 9) with the open central portion of the pattern aligned with the ring 120 of expansion material. The lower pattern 88 engages the plate 116 at locations radially outwardly of the ring 120 of expansion material at locations corresponding to the bottoms of the article molds 76. The bodies 92 (FIG. 6) of expansion material are then positioned on the lower pattern 88. The upper pattern 86 is then positioned in engagement with the bodies 92 of expansion material. A bolt (not shown) extends from the pattern plate 116 to a pattern member in the pour cup of the upper pattern 86 to interconnect the upper and lower patterns 86 and 88. This results in the formation of the pattern assembly 94.

Figure 6:
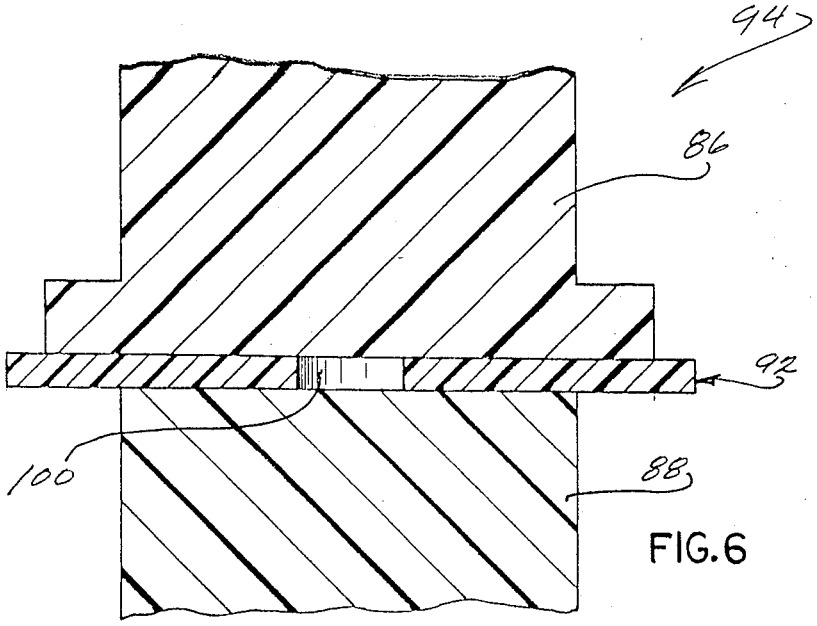
FIG. 6 an enlarged sectional view illustrating the manner in which a body of expansion material separates a pattern having a configuration corresponding to the configuration of the upper section of the mold assembly of FIG. 3 from a pattern having a configuration corresponding to the configuration of the lower section of the mold assembly of FIG. 3.
Figure 7:
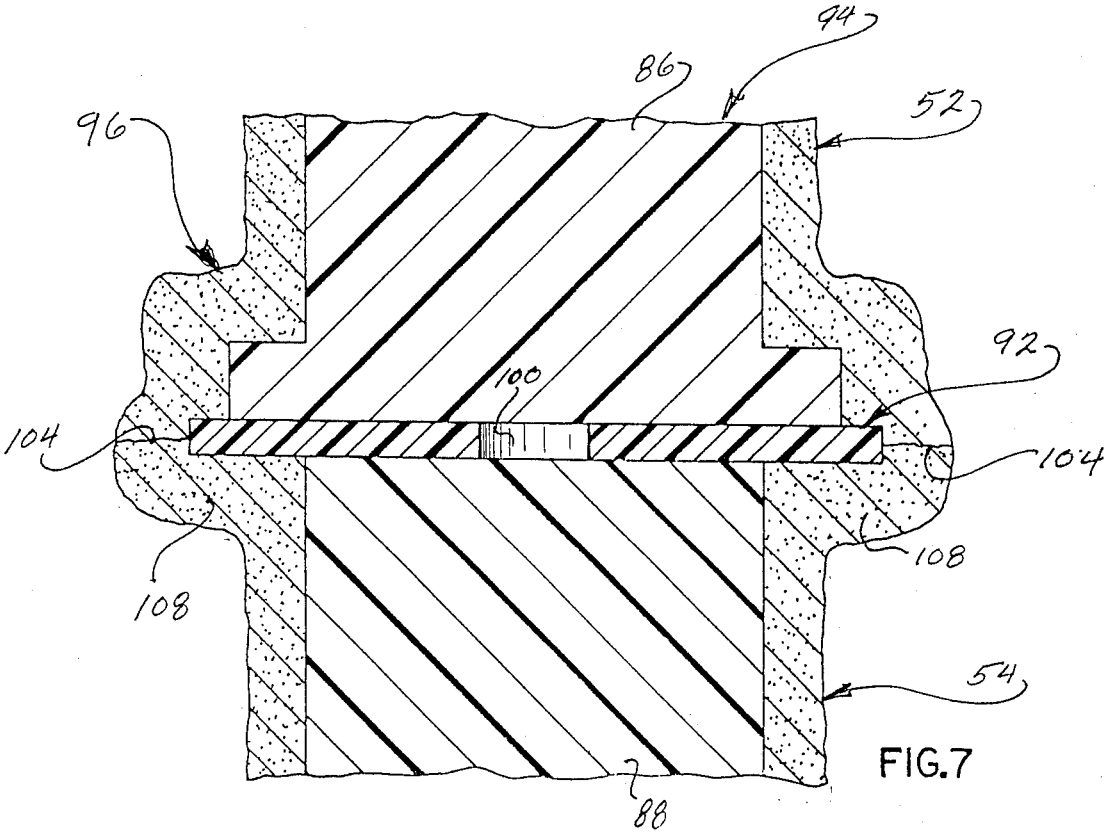
FIG. 7 is a sectional view illustrating how the patterns and body of expansion material of FIG. 6 are covered by a layer of ceramic mold material.
Figure 8:
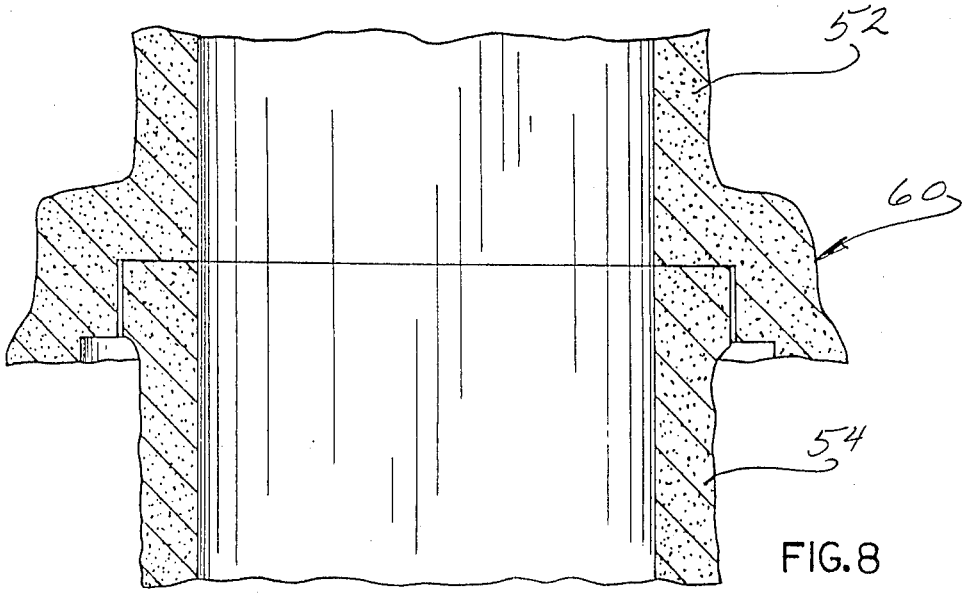
FIG. 8 is a sectional view illustrating how upper and lower mold sections, formed by the layer of ceramic mold material of FIG. 7, are interconnected at a separable joint.
Figure 10:
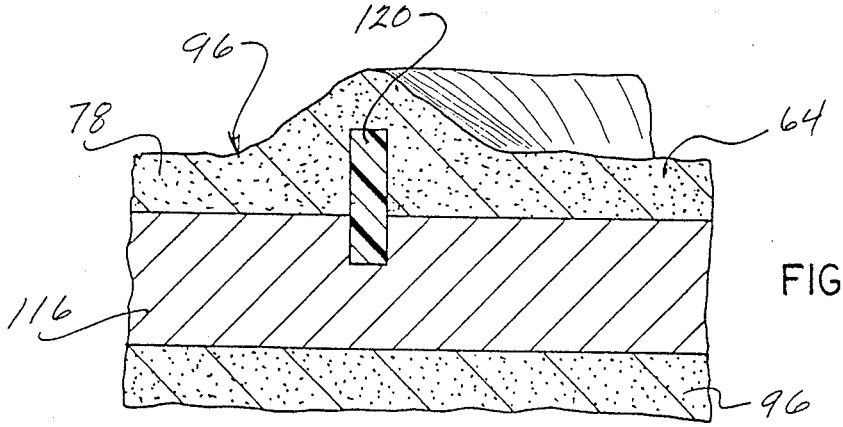
FIG. 10 is a sectional view illustrating the manner in which the pattern plate and ring of expansion material of FIG. 9 are covered by a layer of ceramic mold material which forms a base of the lower mold section of FIG. 4 and a baffle plate of the upper mold section of FIG. 5.

The entire pattern assembly 94 is repetitively dipped in liquid ceramic mold material in the manner previously explained in connection with FIGS. 6 and 7. Therefore the wet coating or layer 96 of ceramic mold material will cover the pattern plate 116 and the ring 120 of expansion material (FIG. 10). The radially outer peripheral surface of the circular plate 116 is wiped each time the pattern assembly is dipped to separate the portion of the layer 96 of ceramic mold material overlying the bottom of the plate from the portion of the ceramic mold material overlying the top of the plate. Once the wet covering 96 of ceramic mold material has been built up to the desired thickness by repetitively dipping the pattern assembly 94, the pattern assembly, including the plate 116, is heated to melt the wax portions of the pattern assembly.

The ring 120 of expansion material has a greater coefficient of thermal expansion than the layer 96 of ceramic mold material. Therefore, when the pattern assembly is heated to dry and dewax the layer 96 of ceramic mold material, the ring 120 expands to a greater extent than the layer of ceramic mold material. This results in a cracking of the layer 96 of ceramic mold material adjacent to the ring 120. These cracks disconnect the portion of the layer 96 of ceramic mold material within the ring 120 from the portion of the layer of ceramic mold material outside of the ring. This results in formation of the baffle plate 64 and annular base plate 78.

Although the ring 120 of expansion material has been described herein as being circular, it is contemplated that the ring could have a different configuration if it is desired to have a baffle plate 64 with a different configuration. The ring 120 is, in the illustrated embodiment of the invention, formed of "Teflon". However other materials could be used if desired.

One of the important features of the invention is the ability to crack the ceramic mold 50 precisely where the parts are to separate and not have it crack in such a manner as to destroy the mold. This is promoted by strategically extending the expansion material into the portions of the mold which are to be cracked. These extensions may be described as crack producing projections or fingers which will crack the surrounding ceramic material. Another factor is the thickness of the expansion material. A greater cracking force is generated by a thick layer of expansion material than a thin layer. Through the control of the foregoing factors, separation can be made to occur along desirable separation lines rather than produce cracks indiscriminately so as to render the mold defective.

Conclusion

Figure 2:
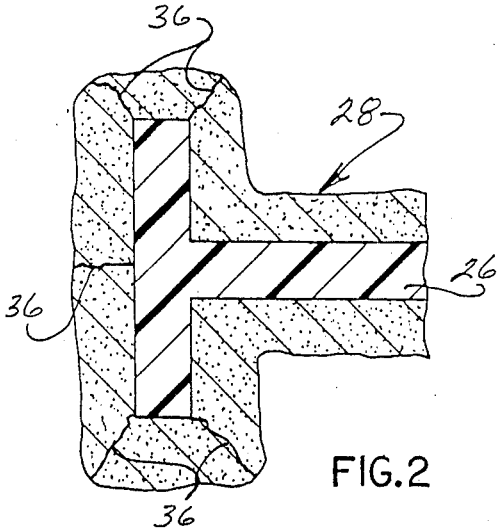
FIG. 2 is a schematic illustration depicting the manner in which the layer of ceramic mold material is cracked by the body of expansion material upon heating of the body of expansion material.

In view of the foregoing description it is apparant that the present invention provides a new and improved method of making a ceramic mold by covering a pattern section 22 and a body 26 of expansion material with a layer 28 of ceramic mold material. The body 26 of expansion material has a greater coefficient of expansion than the layer 28 of ceramic mold material. Therefore, when the body 26 of expansion material and the layer 28 of ceramic mold material are heated, thermal expansion forces are applied against the layer of ceramic mold material by the body of expansion material to crack the layer of ceramic mold material (FIG. 2). The cracking of the layer 28 of ceramic mold material results in one section 40 of the layer of ceramic mold material being disconnected from an adjoining section 42 of the layer of ceramic mold material.

When a mold 50 having two parts 52 and 54 which can be separated is to be formed in accordance with the present invention, patterns 86 and 88 having configurations corresponding to the configurations of the two parts 52 and 54 of the mold 50 are provided. The patterns 86 and 88 are interconnected with one or more bodies of expansion material 92 between the patterns. The resulting pattern assembly 94 is covered with a layer 96 of ceramic mold material. The layer 96 of ceramic mold material extends between and overlies the patterns 86 and 88 and the expansion material 92 between the patterns.

A portion 52 of the layer 96 of ceramic mold material overlying one of the patterns 86 is separated from a portion 54 of the layer of ceramic mold material overlying the other pattern 88 by heating the expansion material 92 and the layer of ceramic mold material. The expansion material 92 has a greater coefficient of thermal expansion than the ceramic mold material 96. Therefore, when the expansion material 92 is heated, it cracks the layer of ceramic mold material 96 to separate the portion of the layer of ceramic mold material overlying one pattern 86 from the ceramic mold material overlying the other pattern 88.

Having described specific preferred embodiments of the invention the following is claimed:

1. A method of making a ceramic mold, said method comprising the steps of providing a pattern, providing a body of expansion material which has a greater coefficient of thermal expansion than the ceramic material of the mold, covering the pattern and body of expansion material with a layer of ceramic mold material, heating the layer of ceramic mold material and body of expansion material, and cracking the layer of ceramic mold material during performance of said step of heating the ceramic mold material and body of expansion material by thermally expanding the body of expansion material to a greater extent than the layer of ceramic mold material.

2. A method as set forth in claim 1 wherein said step of covering the pattern and body of expansion material with a layer of ceramic mold material includes the step of repetitively dipping the pattern and body of expansion material in a slurry of ceramic mold material.

3. A method as set forth in claim 1 wherein said step of covering the pattern and body of expansion material with a layer of ceramic mold material includes the step of applying a wet coating of ceramic mold material over the pattern and body of expansion material, said step of heating the ceramic mold material and body of expansion material including drying the wet coating of ceramic mold material.

4. A method as set forth in claim 1 further including the step of separating the body of expansion material from the layer of ceramic mold material after having performed said step of cracking the layer of ceramic mold material.

5. A method as set forth in claim 1 wherein said step of cracking the layer of ceramic mold material includes dividing the layer of ceramic mold material into a plurality of sections, said method further including the step of interconnecting the sections of ceramic mold material to at least partially assemble a mold.

6. A method as set forth in claim 1 wherein said step of heating the ceramic mold material and body of expansion material includes melting the pattern and separating the melted pattern material from the layer of ceramic mold material.

7. A method as set forth in claim 6 wherein said step of melting the pattern is performed at a temperature which is below the melting temperature of the expansion material.

8. A method of making a ceramic mold assembly having a plurality of mold sections, said method comprising the steps of providing a first pattern section having a configuration corresponding to the configuration of one of the mold sections, providing a second pattern section having a configuration corresponding to the configuration of another mold section, providing a plurality of bodies of expansion material having a coefficient of thermal expansion which is greater than the coefficient of thermal expansion of the ceramic material of the mold, interconnecting the first and second pattern sections with the bodies of expansion material disposed between the first and second pattern sections at a plurality of spaced apart locations to thereby form a pattern assembly, covering the pattern assembly with a layer of ceramic mold material which extends between and overlies the first and second pattern sections at the plurality of spaced apart locations where the bodies of expansion material are disposed between the first and second pattern sections, disconnecting the portion of the layer of ceramic mold material overlying the first pattern section from the portion of the layer of ceramic mold material overlying the second pattern section at the plurality of spaced apart locations where the bodies of expansion material are disposed to thereby form separate mold sections, said step of disconnecting the portion of the layer of ceramic mold material overlying the first pattern section from the portion of the layer of ceramic mold material overlying the second pattern section includes the steps of heating the bodies of expansion material and the layer of ceramic mold material and thermally expanding the bodies of expansion material to a greater extent than the layer of ceramic mold material, and, thereafter, interconnecting the mold sections at a plurality of joints disposed at locations corresponding to the locations of the bodies of expansion material during said step of heating the pattern assembly.

9. A method as set forth in claim 8 wherein the mold assembly includes a baffle plate connected with the one mold section and circumscribed by the other mold section, said method further including providing a pattern member having a ring of expansion material with a coefficient of thermal expansion which is greater than the coefficient of thermal expansion of the ceramic material of the mold, said step of interconnecting the first and second pattern sections includes the step of connecting the first and second pattern sections with the pattern member, said step of covering the pattern assembly with a layer of ceramic mold material includes covering the ring of expansion material and at least one side of the pattern member with the layer of ceramic mold material, said method further including the step of disconnecting the portion of the layer of ceramic mold material overlying the one side of the pattern member and enclosed by the ring of expansion material from the portion of the layer of ceramic mold material overlying the second pattern section, said step of disconnecting the portion of the layer of ceramic mold material enclosed by the ring of expansion material from the portion of the layer of ceramic mold material overlying the second pattern section includes the steps of heating the ring of expansion material and thermally expanding the ring of expansion material to a greater extent than the layer of ceramic mold material.

10. A method as set forth in claim 8 wherein the one mold section includes a primary molten metal distribution system and the other mold section includes a plurality of article molds and a secondary molten metal distribution system connected in fluid communication with the article molds, said step of disconnecting the portion of the layer of ceramic mold material overlying the first pattern section from the portion of the layer of ceramic mold material overlying the second pattern section includes forming a plurality of openings in the primary and secondary molten metal distribution systems, said step of interconnecting the mold sections at a plurality of joints includes interconnecting the mold sections with the openings in the primary and secondary molten metal distribution systems cooperating to partially define a plurality of passages connecting the primary and secondary molten metal distribution systems in fluid communication.

11. A method as set forth in claim 8 wherein said step of disconnecting the portion of the layer of ceramic mold material overlying the first pattern section from the portion of the layer of ceramic mold material overlying the second pattern section includes the step of cracking the layer of ceramic mold material at each of the locations where the bodies of expansion material are disposed between the first and second pattern sections.

12. A method as set forth in claim 8 further including the step of melting the material of the first and second pattern sections during performance of said step of heating the bodies of expansion material and the layer of ceramic mold material, and removing the melted material of the first and second pattern sections from the mold sections.

13. A method as set forth in claim 12 wherein said step of providing a plurality of bodies of expansion material includes providing bodies of expansion material with openings extending through the bodies of expansion material, said step of removing the melted material of the first and second pattern sections from the mold sections includes conducting a flow of melted pattern material through the openings in the bodies of expansion material.

14. A method of forming a mold having a central opening and a baffle plate, said method comprising the steps of providing a mold pattern having a configuration corresponding to the configuration of the mold, providing a pattern plate having a major side surface with a ring of expansion material projecting from the major side surface of the pattern plate, connecting the mold pattern with the major side surface of the pattern plate with the ring of expansion material aligned with a central opening in the mold pattern, covering the major side surface of the pattern plate and the mold pattern with a layer of ceramic mold material having a coefficient of thermal expansion which is less than the coeffient of thermal expansion of the ring of expansion material, heating the layer of ceramic mold material and the ring of expansion material, and disconnecting the portion of the layer of ceramic mold material within the ring of expansion material from the portion of the layer of ceramic mold material outside of the ring of expansion material during performance of said step of heating the layer of ceramic mold material and the ring of expansion material.

15. A method as set forth in claim 14 wherein said step of disconnecting the portion of the layer of ceramic mold material within the ring of expansion material from the portion of the layer of ceramic mold material outside of the ring of expansion material includes the step of cracking the layer of ceramic mold material under the influence of thermal expansion forces applied against the layer of ceramic mold material by the ring of expansion material.

16. A method as set forth in claim 14 further including the steps of separating the portion of the layer of ceramic mold material overlying the surface of the pattern plate within the ring of expansion material from the pattern plate and from the portion of the layer of ceramic mold material overlying the mold pattern to separate the baffle plate from the mold and pattern plate.

17. A method of making a ceramic mold, said method comprising the steps of providing a pattern, providing a body of expansion material which has a greater coefficient of thermal expansion than the ceramic material of the mold, covering the pattern and body of expansion material with a layer of ceramic mold material, heating the layer of ceramic mold material and body of expansion material, cracking the layer of ceramic mold material during performance of said step of heating the ceramic mold material and body of expansion material by thermally expanding the body of expansion material to a greater extent than the layer of ceramic mold material, said step of cracking the layer of ceramic mold material including forming a crack which divides the ceramic mold material into first and second sections, separating the first section of ceramic mold material from the second section of ceramic mold material, and, thereafter, interconnecting the first and second sections of ceramic mold material to at least partially assemble a mold.

18. A method as set forth in claim 17 wherein said step of heating the ceramic mold material and body of expansion material includes melting the pattern and separating the melted pattern material from the layer of ceramic mold material by conducting at least a portion of the melted pattern material through an opening in the body of expansion material.

19. A method as set forth in claim 17 wherein said step of melting the pattern is performed at a temperature which is below the melting temperature of the expansion material.

20. A method of making a ceramic mold assembly, said method comprising the steps of providing a first pattern section having a first configuration, providing a second pattern section having a second configuration, providing a body of expansion material having a coefficient of thermal expansion which is greater than the coefficient of thermal expansion of the ceramic material of the mold, interconnecting the first and second pattern sections with the body of expansion material disposed between the first and second pattern sections to thereby form a pattern assembly, covering the pattern assembly with a layer of ceramic mold material which overlies the first and second pattern sections, heating the pattern assembly and the layer of ceramic mold material, thermally expanding the body of expansion material to a greater extent than the layer of ceramic mold material, cracking the layer of ceramic mold material during performance of said step of thermally expanding the body of expansion material to divide the ceramic mold material into first and second mold sections, separating the first mold section from the second mold section, and, thereafter, interconnecting the first and second mold sections at a joint disposed at a location corresponding to the location of the body of expansion of material during said step of heating the pattern assembly.

21. A method as set forth in claim 20 wherein the mold assembly includes a baffle plate connected with the first mold section and circumscribed by the second mold section, said method further including providing a pattern member having a ring of expansion material with a coefficient of thermal expansion which is greater than the coefficient of thermal expansion of the ceramic material of the mold, said step of interconnecting the first and second pattern sections includes the step of connecting the first and second pattern sections with the pattern member, said step of covering the pattern assembly with a layer of ceramic mold material includes covering the ring of expansion material and at least one side of the pattern member with a layer of ceramic mold material, said method further including the step of disconnecting the portion of the layer of ceramic mold material overlying the one side of the pattern member and enclosed by the ring of expansion material from the portion of the layer of ceramic mold material overlying the second pattern section, said step of disconnecting the portion of the layer of ceramic mold material enclosed by the ring of expansion material from the portion of the layer of ceramic mold material overlying the second pattern section includes the steps of heating the ring of expansion material and thermally expanding the ring of expansion material to a greater extent than the layer of ceramic mold material.

22. A method as set forth in claim 20 wherein the first mold section includes a molten metal distribution system and the second mold section includes an article mold, said step of separating the first mold section from the second mold section includes forming an opening in the molten metal distribution system and the second mold section, said step of interconnecting the mold sections at a joint includes interconnecting the mold sections with the openings cooperating to partially define a passage connecting the molten metal distribution system in fluid communication with the article mold.

23. A method as set forth in claim 20 further including the step of melting the material of the first and second pattern sections during performance of said step of heating the pattern assembly and the layer of ceramic mold material, and removing the melted material of the first and second pattern sections from the mold sections.

24. A method as set forth in claim 23 wherein said step of providing a body of expansion material includes providing a body of expansion material with an opening extending through the body of expansion material, said step of removing the melted material of the first and second pattern sections from the mold sections includes conducting a flow of melted pattern material through the opening in the body of expansion material.

* * * * *